US005254820A

United States Patent [19]

Pesheck et al.

[11] Patent Number: 5,254,820

[45] Date of Patent: Oct. 19, 1993

[54] ARTIFICIAL DIELECTRIC TUNING DEVICE FOR MICROWAVE OVENS

[75] Inventors: Peter S. Pesheck, Minneapolis; Ronald R. Lentz, Plymouth, both of Minn.

[73] Assignee: The Pillsbury Company, Minneapolis, Minn.

[21] Appl. No.: 615,033

[22] Filed: Nov. 19, 1990

[51] Int. Cl.[5] ..... H05B 6/64

[52] U.S. Cl. ..... 219/10.55 E; 219/10.55 F; 219/10.55 M; 219/10.55 B; 99/DIG. 14; 426/107; 426/243; 374/122; 374/149

[58] Field of Search ..... 219/10.55 E, 10.55 F, 219/10.55 M, 10.55 B; 99/DIG. 14; 436/107; 426/243; 374/122, 149

[56] References Cited

U.S. PATENT DOCUMENTS

| | | | |
|---|---|---|---|
| 3,271,169 | 9/1966 | Baker et al. | 219/10.55 E |
| 3,353,968 | 11/1967 | Krajewski | 219/10.55 E |
| 3,783,220 | 1/1974 | Tanizaki | 219/10.55 E |
| 3,841,112 | 6/1974 | Peleg | 219/10.55 E |
| 3,857,009 | 12/1974 | MacMaster et al. | 219/10.55 E |
| 3,865,301 | 2/1975 | Pothier et al. | 99/DIG. 14 |
| 3,887,920 | 6/1975 | Wright et al. | 343/18 A |
| 3,934,106 | 1/1976 | MacMaster et al. | 219/10.55 E |
| 3,946,188 | 3/1976 | Derby | 219/10.55 E |
| 3,965,323 | 6/1976 | Forker, Jr. et al. | 219/10.55 E |
| 4,015,085 | 3/1977 | Woods | 219/10.55 E |
| 4,032,865 | 6/1977 | Harp et al. | 333/21 R |
| 4,143,647 | 3/1979 | Husslein et al. | 126/390 |
| 4,190,757 | 2/1980 | Turpin et al. | 219/10.55 E |
| 4,230,924 | 10/1980 | Brastad et al. | 219/10.55 E |
| 4,258,086 | 3/1981 | Beall | 219/10.41 |
| 4,266,108 | 5/1981 | Anderson et al. | 219/10.55 E |
| 4,283,427 | 8/1981 | Winters et al. | 426/107 |
| 4,369,346 | 1/1983 | Hart et al. | 219/10.55 E |
| 4,398,077 | 8/1983 | Freedman et al. | 219/10.55 E |
| 4,486,640 | 12/1984 | Bowen et al. | 219/10.55 E |
| 4,496,815 | 1/1985 | Jorgensen | 219/10.55 E |
| 4,542,271 | 9/1985 | Tanonis et al. | 219/10.55 E |
| 4,626,641 | 12/1986 | Brown | 219/10.55 E |
| 4,641,005 | 2/1987 | Seiferth | 219/10.55 E |
| 4,656,325 | 4/1987 | Keefer | 219/10.55 E |
| 4,676,857 | 6/1987 | Scharr et al. | 156/233 |
| 4,698,472 | 10/1987 | Cox et al. | 219/10.55 E |
| 4,742,203 | 5/1988 | Brown et al. | 219/10.55 E |
| 4,751,358 | 6/1988 | Durand | 219/10.55 E |
| 4,806,718 | 2/1989 | Seaborne et al. | 219/10.55 E |
| 4,808,780 | 2/1989 | Seaborne | 219/10.55 E |
| 4,810,845 | 3/1989 | Seaborne | 219/10.55 E |
| 4,814,568 | 3/1989 | Keefer | 219/10.55 E |
| 4,818,831 | 4/1989 | Seaborne | 219/10.55 E |
| 4,825,024 | 4/1989 | Seaborne | 219/10.55 E |
| 4,825,025 | 4/1989 | Seiferth | 219/10.55 E |
| 4,864,089 | 9/1989 | Tighe et al. | 219/10.55 E |

(List continued on next page.)

OTHER PUBLICATIONS

*Microwave Technology & Food Science: Where Are They In The Marketplace*? written by Harry A. Rubbright, "Microwave World", vol. 9, No. 6, 1988.

*The Microwave Patent Mess*, "Food & Beverage Marketing", Nov. 1989 by Fred Pfaff.

*Browning & Crisping The Functions, Design, and Operation of Susceptors* "Microwave World", vol. 10, No. 6 by Charles Turpin.

*Using Science For Consumer Products: An ISMI-CAS Connection*? by John P. O'Meara, "Microwave World", vol. 9, No. 6, 1988.

*Primary Examiner*—Bruce A. Reynolds
*Assistant Examiner*—Tu Hoang
*Attorney, Agent, or Firm*—Kinney & Lange

[57] ABSTRACT

An apparatus is suitable for use in a microwave oven. An artificial dielectric is located adjacent or within a food product cooking stack in the microwave oven. A support media supports the artificial dielectric in the cooking stack at a desired distance from the oven shelf. The artificial dielectric has properties suitable so that the cooking stack can be positioned in the microwave oven to achieve desired cooking performance.

17 Claims, 12 Drawing Sheets

U.S. PATENT DOCUMENTS 4,865,921 9/1989 Hollenberg et al. ..... 428/461
4,870,233 9/1989 McDonald et al. ..... 219/10.55 E
4,876,423 10/1989 Tighe et al. ..... 219/10.55 E
4,883,936 11/1989 Maynard et al. ..... 219/10.55 F
4,888,459 12/1989 Keefer ..... 219/10.55 E
4,892,782 1/1990 Fisher et al. ..... 428/240
4,894,247 1/1990 Fong ..... 426/107
4,904,836 2/1990 Turpin et al. ..... 219/10.55 E
4,914,266 4/1990 Parks et al. ..... 219/10.55 E
4,917,907 4/1990 Kwis et al. ..... 426/90
4,925,684 5/1990 Simon ..... 426/107
4,936,935 6/1990 Beckett ..... 156/239
4,940,867 7/1990 Peleg ..... 219/10.55 E
4,943,456 7/1990 Pollart et al. ..... 428/34.3
4,962,000 10/1990 Emslander et al. ..... 219/10.55 E
4,970,360 11/1990 Pesheck et al. ..... 219/10.55 E
5,019,681 5/1991 Lorence et al. ..... 219/10.55 F

ARTIFICIAL DIELECTRIC TUNING DEVICE FOR MICROWAVE OVENS

INCORPORATION BY REFERENCE

A patent application entitled THICK METAL MICROWAVE SUSCEPTOR, Ser. No. 07/609,910, filed on Nov. 6, 1990, by Pesheck et al. and assigned to the same assignee as the present application is hereby fully incorporated by reference.

BACKGROUND OF THE INVENTION

The present invention involves microwave cooking. More particularly, the present invention is an apparatus for the electrical tuning of a cooking stack in a microwave oven.

The term cooking stack generally refers to a number of generally planar layers in a microwave oven during operation of the oven. A cooking stack can include a food product to be cooked, which may have several layers, along with any device for holding the food product (such as a support member and a lid), as well as an oven shelf and any air layers in the microwave oven between the oven floor and the lid or the top of the food product. For example, a typical cooking stack for cooking a frozen pizza may have several layers including the pizza sauce, the crust, a platform for holding the frozen pizza in the microwave oven, the oven shelf, and any air layer between the oven shelf and the oven floor. The platform for holding the pizza may typically include a pizza box in which the frozen pizza was purchased.

Heating of such food products in a microwave oven differs from heating foods in a conventional oven, and several problems can arise in achieving desired cooking performance. In a conventional oven, heat energy is applied to the exterior surface of the food and moves inward until the food is cooked. Thus, food cooked conventionally is typically hot on the outer surfaces and warm in the center.

Microwave cooking, on the other hand, involves absorption, by the food, of microwaves which characteristically penetrate the food much more deeply than does infrared radiation (heat). Also, in microwave cooking, the air temperature in the microwave oven may be relatively low. Therefore, it is not uncommon for food cooked in a microwave oven to be cool on the surfaces and much hotter in the center. This makes it difficult to brown food and make it crisp.

In order to facilitate browning and crisping of food in a microwave oven, devices known as susceptors have been developed. Susceptors are devices which, when exposed to microwave energy, become very hot. By placing a susceptor next to a food product in a microwave oven, the surface of the food product exposed to the susceptor is heated by the susceptor and thereby becomes crisp and brown.

However, susceptors do not solve all cooking problems associated with microwave ovens. There are also problems which arise from the location of standing waves in the microwave oven that affect cooking performance. The solution to these problems requires positioning certain layers of the cooking stack in the microwave oven so that the food product is located relative to the electric field in the microwave oven to achieve desired cooking performance.

SUMMARY OF THE INVENTION

In some cooking situations, for optimum cooking of a food product, the food product must be located in the microwave oven with an impractically large spacing between the bottom of the oven (or the oven shelf) and the food product. This is true for several reasons. In some cases, the food product or a particular layer in the food product should be located where the electrical field within the microwave oven is strongest, and in other cases a relatively low electric field is desirable. In still other cases, it is desirable that a microwave susceptor be placed in a position to accommodate maximum power absorption. In any case, it is often impractical to locate the food properly to accommodate for the large spacing required for desired cooking performance.

The present invention includes an apparatus for adjusting absorption of microwave energy in the microwave oven to achieve desired absorption, while maintaining spacing of practical size. An artificial dielectric structure is located adjacent to or within a cooking stack in the microwave oven. The artificial dielectric is chosen with properties so that standing waves in the oven are adjusted for a desired heating effect, while the spacing between the food product and the oven shelf or oven floor is small enough to be practically implemented.

In one preferred embodiment, the artificial dielectric is a polymer, such as paint, loaded with metal flakes. In another preferred embodiment, the artificial dielectric includes metal patches loaded within a dielectric material, or applied to the surface of a dielectric material.

DETAILED DESCRIPTION OF THE PREFERRED EMBODIMENTS

Artificial dielectrics increase charge stored in a capacitor in much the same way as molecules of a common dielectric medium—by an induced dipole moment. The dipoles in artificial dielectrics are supplied by burying conductive shapes such as plates, disks, rods and ellipsoids inside a dielectric material. The conductive objects are small with respect to the wavelength in the surrounding media, but large relative to molecular dimensions. This is set out more fully in Schelkunoff and Friis, *Antennas, Theory and Practice,* pages 576-590. These pages are fully incorporated by reference herein.

The present invention utilizes the theory of artificial dielectrics to multiply the complex relative dielectric constant, $\epsilon_r$, of a dielectric material in order to achieve desired cooking results in a microwave oven while using a relatively thin dielectric layer. In other words, the present invention uses the theory of artificial dielectrics to adjust standing waves in a microwave oven to achieve desired cooking performance and still maintain a practical dimension for a cooking stack in the microwave oven.

The complex permittivity of a dielectric material is:

$$\epsilon = \epsilon_0\epsilon_r = \epsilon_0(\epsilon'_r - j\epsilon''_r)$$

where $\epsilon_0$ is permittivity of free space ($8.854 \times 10^{-14}$ Farads/cm);

$\epsilon_r$ = the complex relative dielectric constant of the material;

$\epsilon'_r$ = the real part of the complex relative dielectric constant; and $\epsilon''_r$ = the imaginary part of the complex relative dielectric constant (also known as the loss factor). Also, $$\epsilon''_r = \frac{\sigma}{\omega\epsilon_0} \qquad \text{Eq. 2}$$

where $\omega = 2\pi f$;

f = the operating frequency of the microwave oven; and $\sigma$ = the electrical conductivity in $(\text{Ohm cm})^{-1}$.

When $\epsilon''_r$ greatly exceeds $\epsilon'_r$ of the dielectric layer, as in the case of, for example, aluminum, the layer may be characterized by a surface resistance:

$$R_s = \frac{1}{\sigma d} \qquad \text{Eq. 3}$$

Where d is the layer thickness. For materials without such a great disparity between $\epsilon''_r$ and $\epsilon'_r$, a complex surface impedance of an electrically thin layer is given approximately by:

$$Z_s = \frac{1}{j\omega\epsilon_0\epsilon_r d} \qquad \text{Eq. 4}$$

This equation is useful for determining reflected, absorbed and transmitted power in a transmission line. Thus, elementary transmission line theory may be used to calculate the fraction of the incident power dissipated in the dielectric layer which is represented as a shunt impedance across the transmission line.

Figures 1, 2:
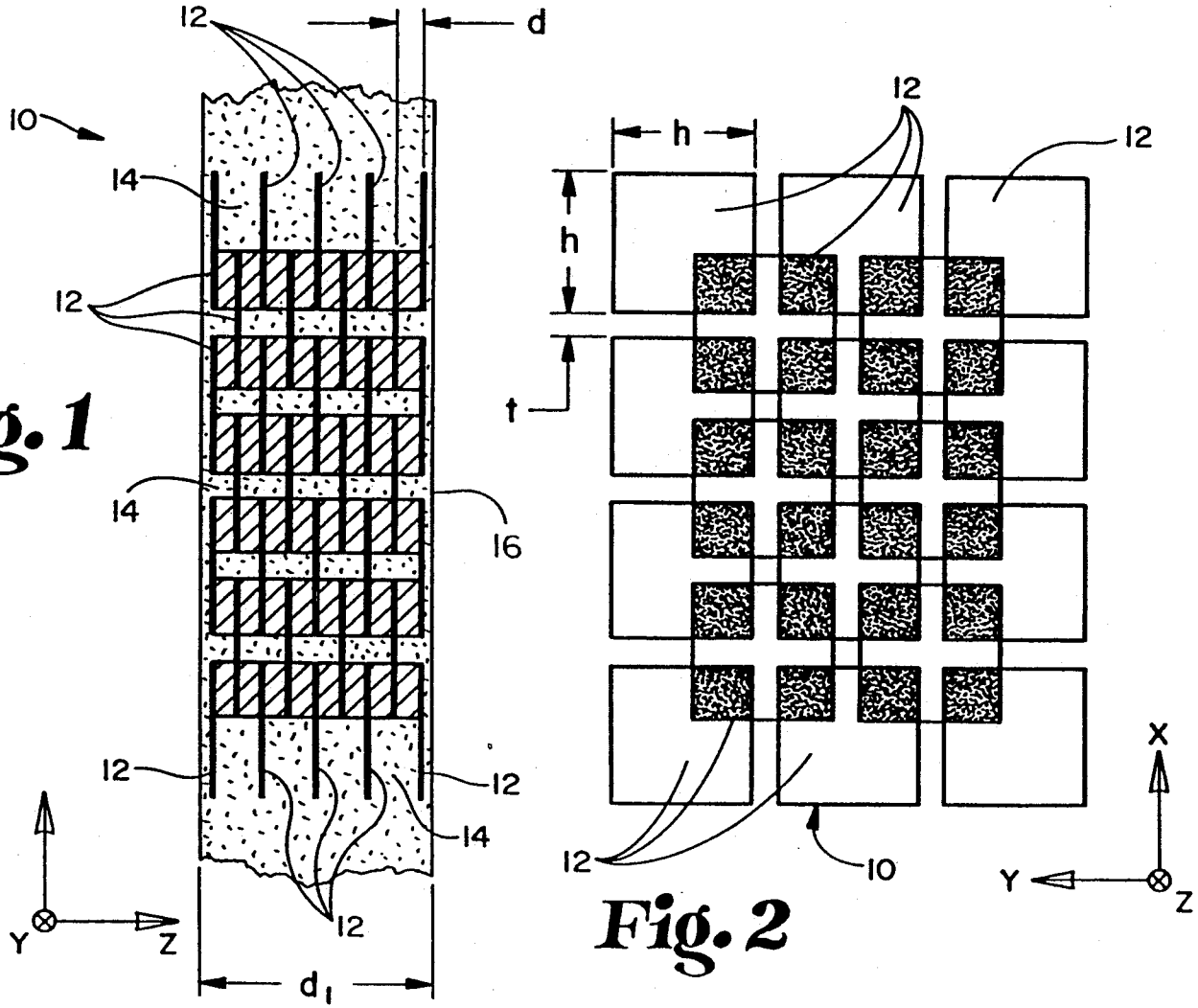
FIG. 1 is a side view of a multi-layer dielectric of the present invention.
FIG. 2 is a top plan view showing overlap of the layers shown in FIG. 1 when they are assembled.

FIG. 1 is an illustration of the present invention. An artificial dielectric layer 10 shown in FIG. 1 includes a plurality of highly conductive metal patches 12 physically loaded into dielectric material 14. The metal patches 12, each of which is small with respect to the wavelength in the unloaded dielectric material 14, may take different forms. In this preferred embodiment, they are square flat plates suitably arranged in offset layers as shown in FIG. 1. Offset square flat plates 12 have a relatively large multiplicative affect on the complex dielectric constant of dielectric layer 10 when compared to the effect of, for example, ellipsoids, wires or other shapes.

FIG. 2 is a top view of a portion of dielectric layer 10 showing the square metal patches 12, and illustrating the overlapping effect of the layers of patches 12. Patches 12 have sides of length h and lie in the plane of a generally flat planar surface 16, and are separated from one another by a gap t between the edges. As FIGS. 1 and 2 illustrate, dielectric layer 10 is a three dimensional dielectric layer formed of a number of layers of metal patches. Each layer is spaced a distance, d, in the z direction, from the next adjacent layers, one above and one below. Also, each layer is offset by half a repeat cell width, ((h +t)/2), in the x and y directions from its nearest neighboring layer.

Although the dielectric material 14 surrounds plates 12, material 14 between opposing plates is highlighted by cross hatching in FIG. 1 and is shown as shaded portions in FIG. 2. This cross hatching forms the dielectric part of the current path through dielectric material 14.

The effect of the stack of metal patches 12 in dielectric material 14 is to increase the tortuosity of the current path through artificial dielectric layer 10 and through patches 12 for currents induced by a component of the electric field in the microwave oven lying in the xy plane. The complex dielectric constant of the unloaded dielectric material 14 is thus multiplied by a factor of:

$$s = \left(\frac{h-t}{2d}\right)^2 \qquad \text{Eq. 5}$$

This creates an effective dielectric constant which can be much larger than the value of the dielectric constant in the original unloaded material. Hence, the complex relative dielectric constant of the dielectric layer is multiplied by s, which can be large (e.g., $\geqq 300$) if patches 12 are arranged so that the interlayer spacing is much smaller than h−t.

In short, the present invention works by placing a layer, such as layer 10 which is formed to have a high effective dielectric constant, in a cooking stack. This desirably changes the standing wave pattern in the cooking stack so that power is concentrated at a desired location in the cooking stack to achieve desired cooking performance. In this context, $\epsilon_r'$, the real part of $\epsilon_r$ should be large since it most directly influences phase shifts on incident and reflected microwaves in the microwave oven. However, in order to avoid substantial heating in the artificial dielectric layer itself, $\epsilon_r''$ (or o) should be small. $\epsilon_r$ is adjusted by changing the size and spacing of patches 12 and the layer thickness $d_1$, the standing wave pattern can be adjusted to achieve desired cooking performance, often requiring only minor changes in the thickness of various components of the cooking stack.

Figure 2A:
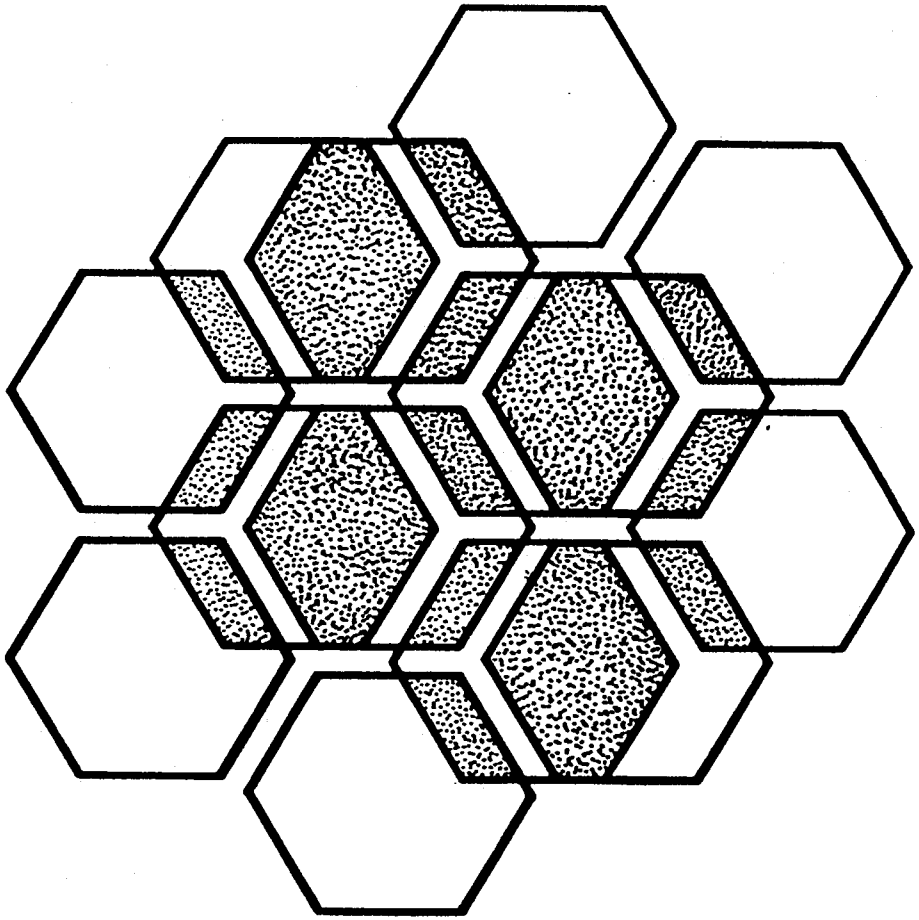
FIG. 2A shows an alternative embodiment of the multi-layer dielectric shown in FIG. 1.
Figure 2B:
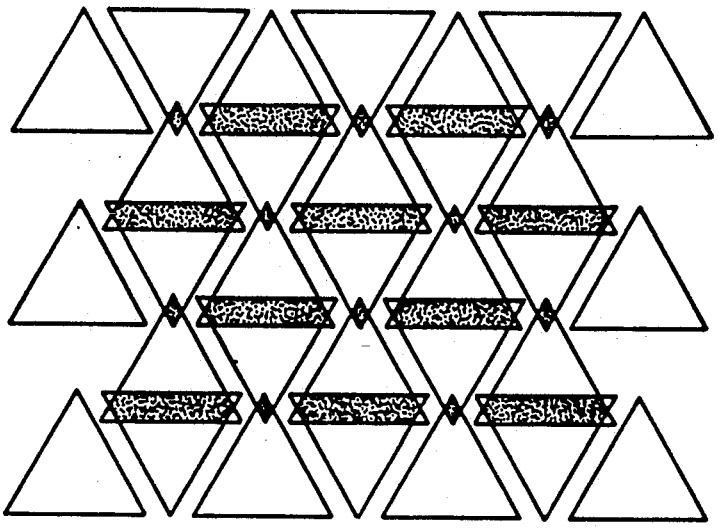
FIG. 2B shows a second alternative embodiment of the multi-layer dielectric shown in FIG. 1.
Figure 2C:
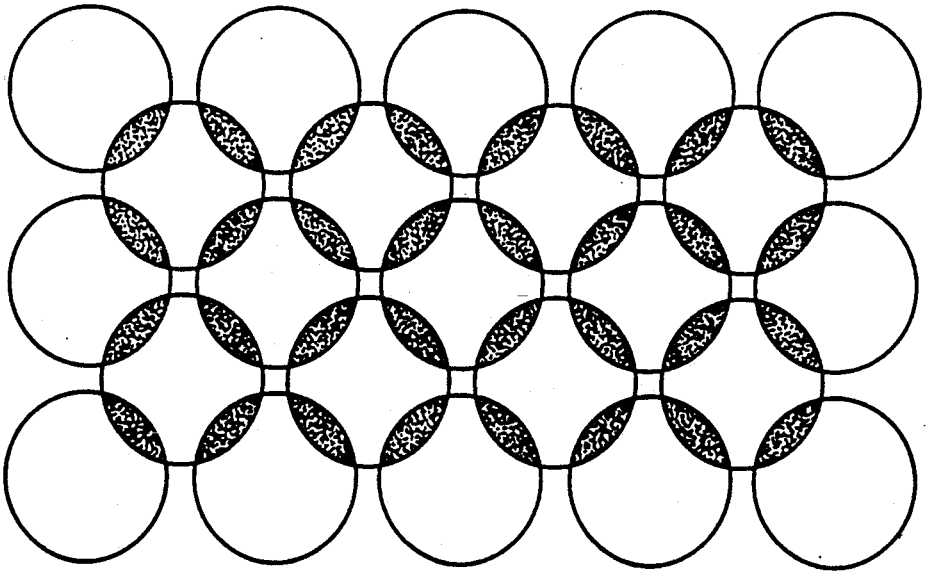
FIG. 2C shows a third alternative embodiment of the multi-layer dielectric shown in FIG. 1.

FIGS. 2A–2C show alternatively shaped patches used to form dielectric layer 10. These shapes all provide increased tortuosity of the current path through layer 10 and through the conductive patches, thereby increasing the dielectric constant of the material.

Figure 3:
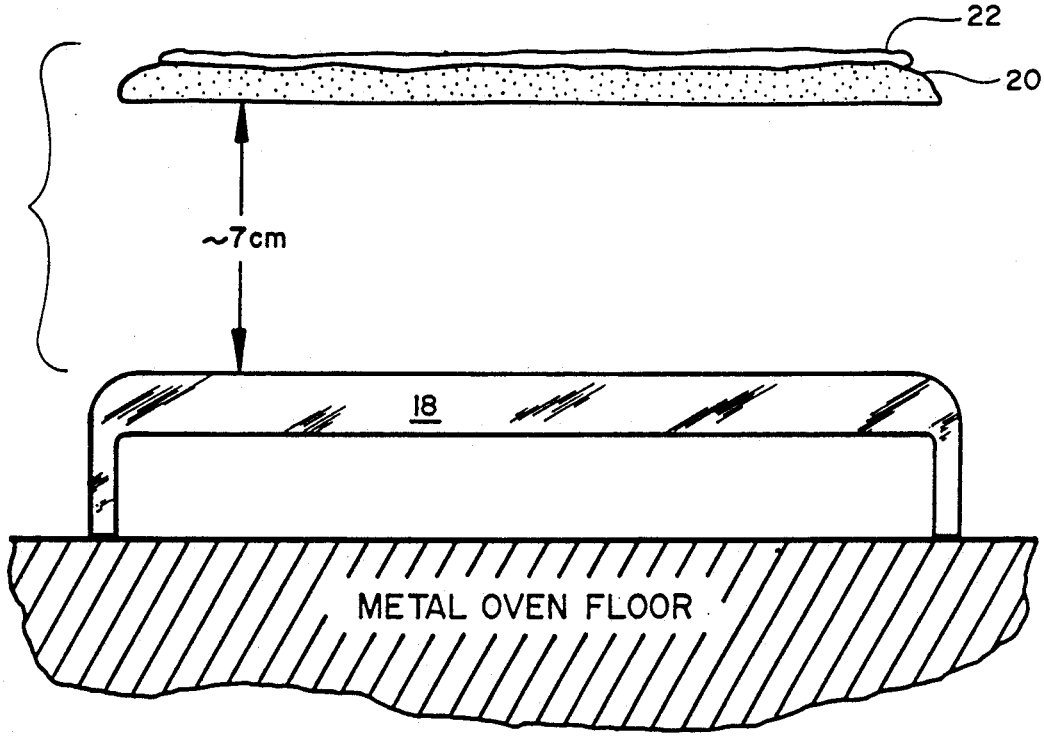
FIG. 3 shows a cooking stack.

FIG. 3 shows a typical cooking stack in a microwave oven. The cooking stack includes the metal oven floor, the oven shelf 18 (and any air layer below the oven shelf), pizza crust 20 and pizza sauce 22. In order to place the pizza crust 20 and sauce 22 in a place within the microwave oven so that it will experience optimum cooking performance, it is necessary to locate crust 20 and sauce 22 where the electric field within the microwave oven is the highest. Without a dielectric layer 10, this would typically require crust 20 and sauce 22 to be placed a distance, on the order of 7 cm, above the oven shelf 18 due to the characteristics of the standing wave pattern in a typical microwave oven. That distance can vary with cooking applications, but is often impractically large.

By using the artificial dielectric layer 10 shown in FIG. 1, the standing wave pattern can be adjusted so that the pizza crust 20 and sauce 22 can be positioned at a practical height above the oven shelf 18. In fact, by using the proper dielectric structure, and by implementing the dielectric structure in a food package, the food package itself can be used in cooking the food product as a spacer to locate the food product an adequate distance above the oven shelf 18. One example of such a food package is shown in FIGS. 4–6.

Figure 4:
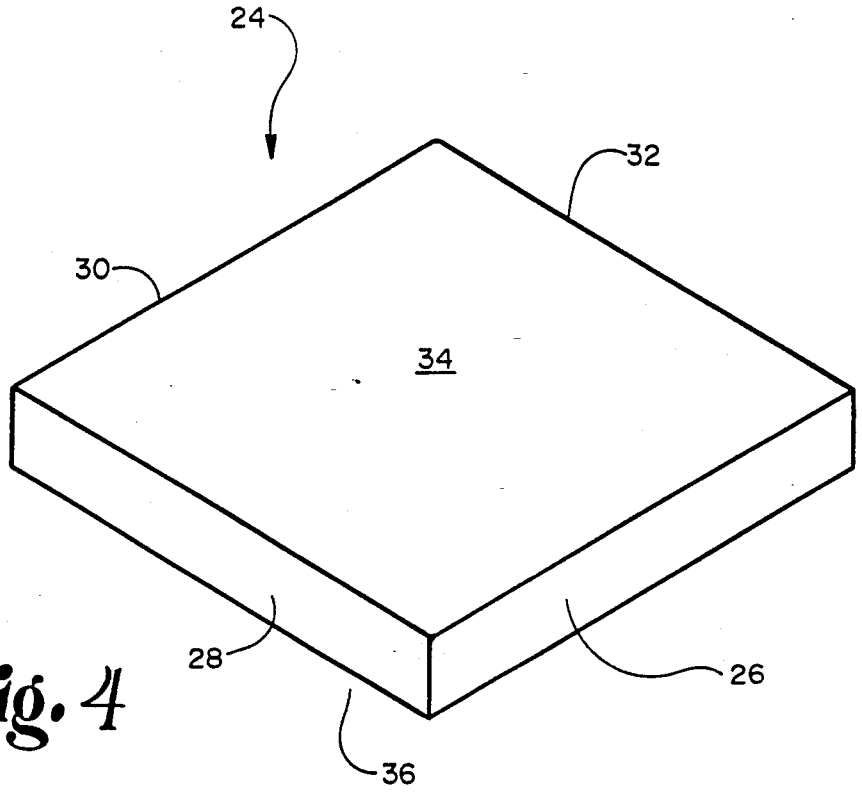
FIG. 4 shows a food product package implementing the apparatus of the present invention.

FIG. 4 shows a package 24 which contains, for example, a microwave pizza. The package 24, as will be discussed, is used as a cooking stand for cooking the microwave pizza and is preferably formed of paperboard or low loss plastic. The dielectric layer 10, as described with reference to FIGS. 1 and 2, along with a susceptor 19, is incorporated into the bottom panel of the package 24. By placing the pizza on the package 24, and inserting the entire package, along with the pizza, into the microwave oven, the pizza is properly positioned for substantially optimum cooking performance.

Figure 5:
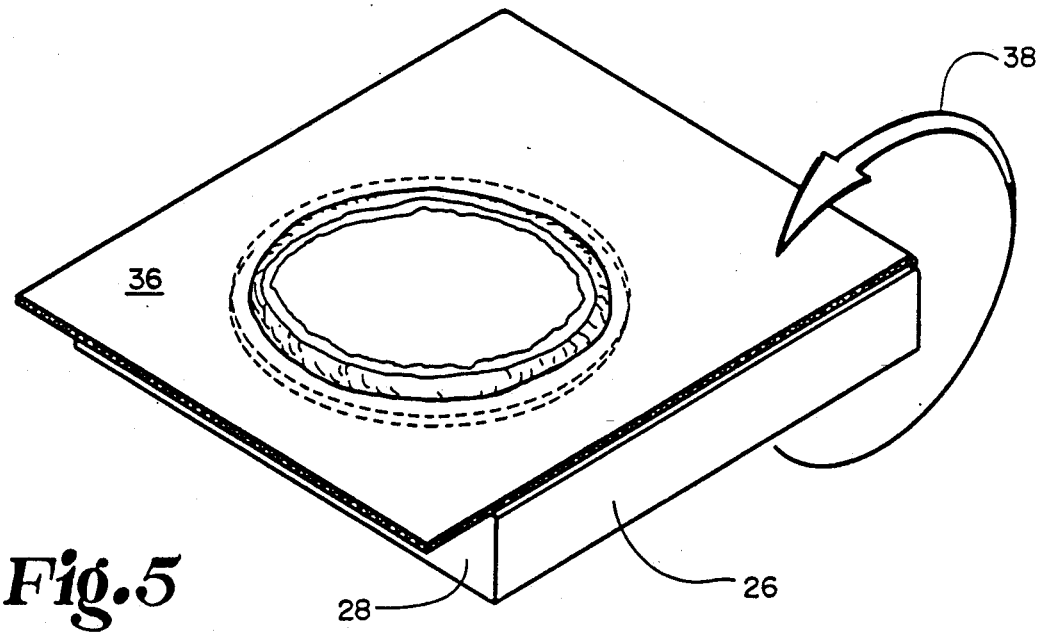
FIG. 5 shows the package of FIG. 4 as used during microwave cooking.
Figure 6:
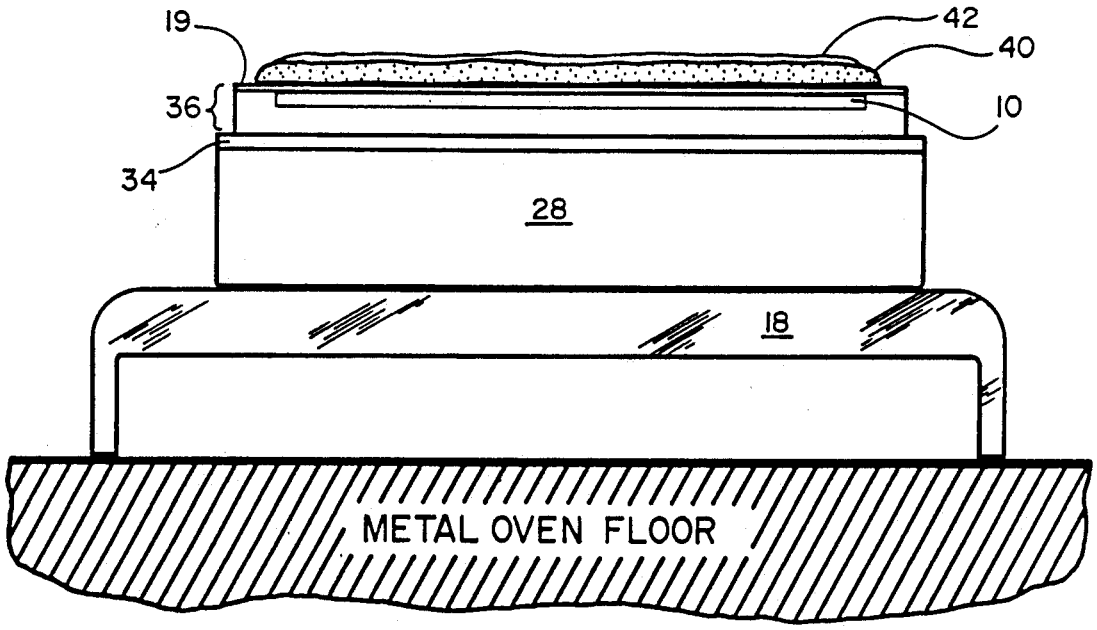
FIG. 6 shows a side view of the package of FIG. 5.

The food product package shown in FIGS. 4–6 includes side flaps 26, 28, 30 and 32, top panel 34 and a bottom panel 36. In this preferred embodiment, the artificial dielectric structure 10 (shown in FIGS. 1 and 2), along with a susceptor 19, is loaded into the bottom panel 36 of the food product package 24 shown in FIG. 4.

FIG. 5 shows a cooking arrangement using the food product package 24. When the package is opened and the frozen microwave pizza is removed, bottom panel 36 is folded along a seam to cover top panel 34. This is indicated by arrow 38. Then, the frozen pizza is placed on panel 36 and the entire package, with the frozen pizza, is placed in the microwave oven.

FIG. 6 shows a side view of the resulting cooking stack. The pizza includes crust 40 and sauce 42. Bottom panel 36, which has been folded over top panel 34, includes susceptor 19 and artificial dielectric layer 10. The cooking stack also includes the rest of the food product package 24, oven shelf 18, the metal oven floor and the air space between oven shelf 18 and the metal oven floor. The food product package 24 is approximately 1.8 cm in height. By using the artificial dielectric layer 10, the standing wave pattern in the microwave oven is adjusted so that 1.8 cm in height is adequate to achieve desired microwave cooking of the frozen pizza. This is a much more practical height than 7 cm.

Figure 7:
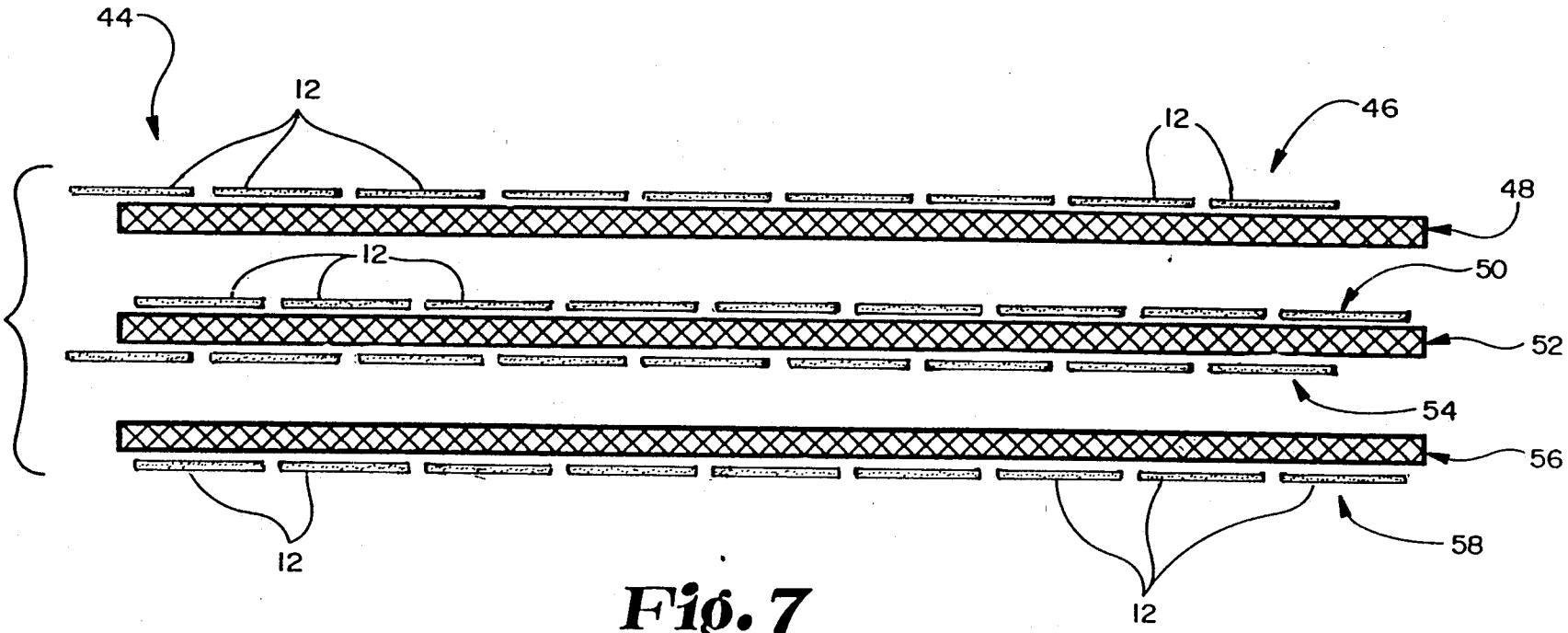
FIG. 7 is a side view showing a dielectric layer of the present invention.

FIG. 7 shows another preferred embodiment of a loaded artificial dielectric layer 44. Artificial dielectric layer 44 includes layer 46 of spaced metal patches 12, dielectric material layer 48, layer 50 of spaced metal patches 12, dielectric layer 52, layer 54 of spaced metal patches 12, dielectric layer 56, and layer 58 of spaced metal patches 12. In this preferred embodiment, metal patches 12 are square patches of aluminum foil. Dielectric layers 48, 52 and 56 are corrugated paper layers which are 0.335 cm thick. Layers 46, 50, 54 and 58 are coupled to dielectric layers 48, 52 and 56, in this preferred embodiment, by glue.

It should be noted that dielectric layer 44 can be made by cutting three identical strips of corrugated paper to be used as layers 48, 52 and 56. Similarly, two sets of identical layers of metal patches can be formed since layers 46 and 54 are identical, and since layers 50 and 58 are also identical. Layers 50 and 58 are simply offset by one half of the spatial period in each of the two orthogonal directions from layers 46 and 54.

Figure 7A:
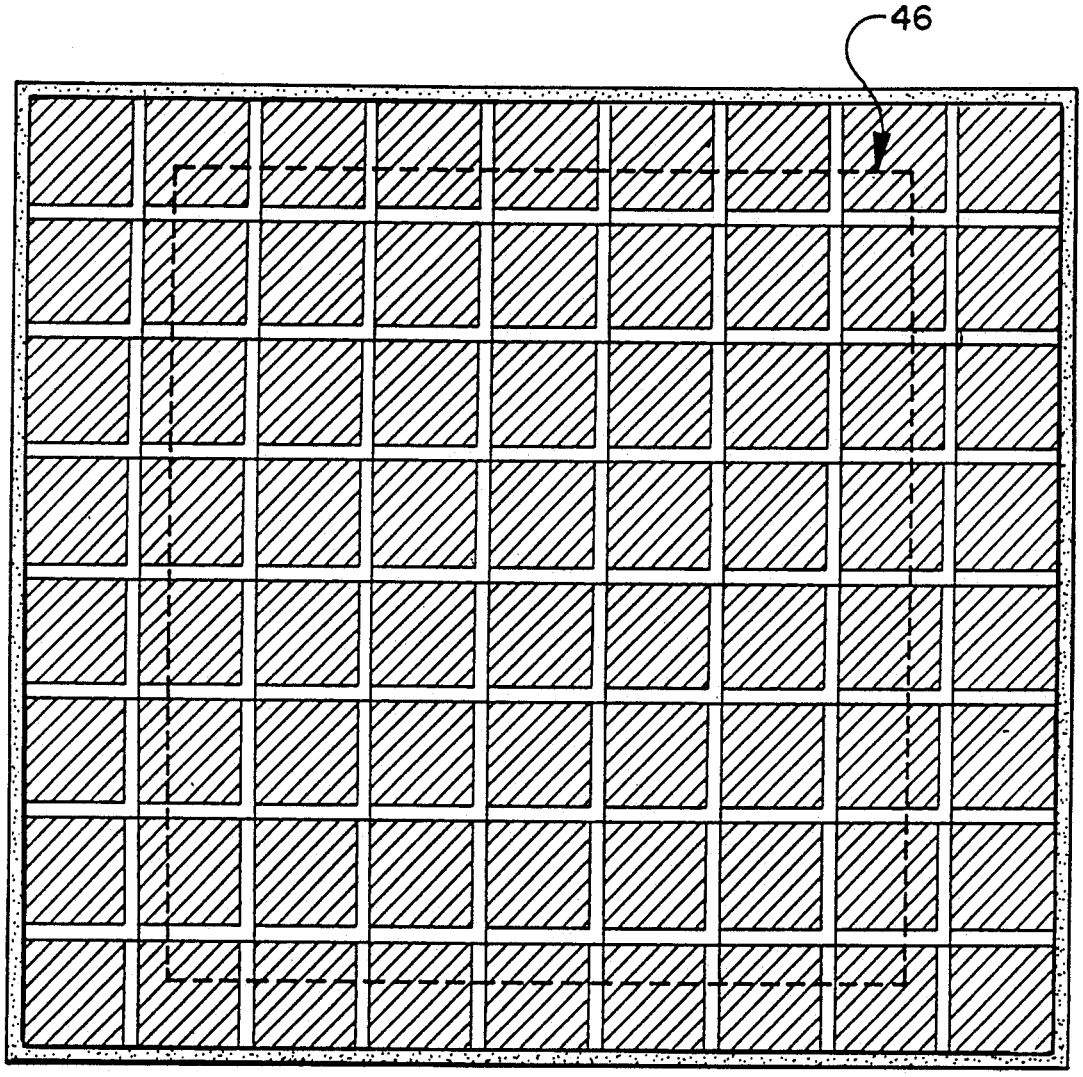
FIG. 7A is a top view of a first portion of the dielectric layer of FIG. 7.

FIG. 7A shows a typical layer of metal patches 12. One such layer is used as layer 46 and another identical layer is used as layer 54. The metal patches 12 used to form the layers are 2 cm square and are spaced 0.2 cm apart. Layers 46 and 54, in this preferred embodiment, are 14 cm × 14.5 cm in dimension.

Figure 7B:
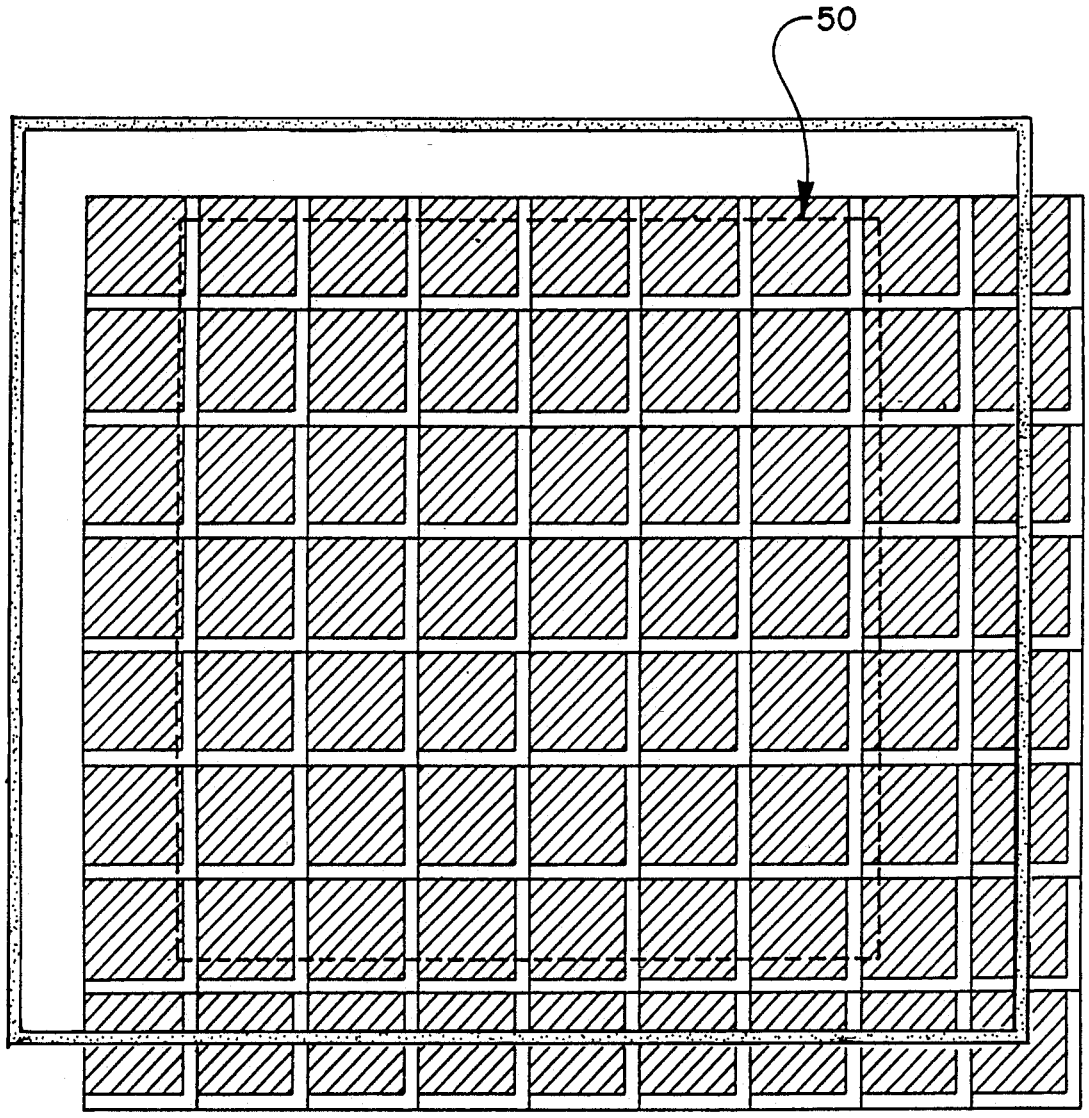
FIG. 7B is a top view of a second portion of the dielectric layer of FIG. 7.

FIG. 7B shows another typical layer of metal patches 12. One such layer is used as layer 50 and another identical layer comprises layer 58. The metal patches 12 of the layer shown in FIG. 7B are also 2 cm square and spaced 0.2 cm apart. The layer shown in FIG. 7B also measures 14 cm × 14.5 cm in dimension.

Figure 8:
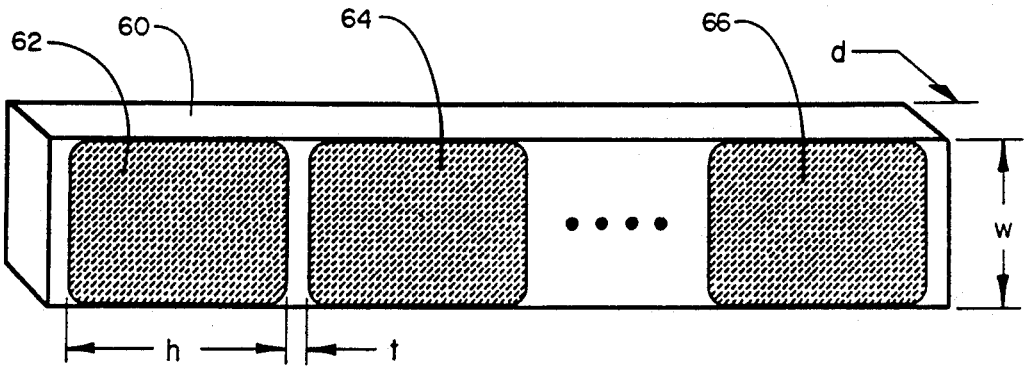
FIG. 8 is a top perspective view of a dielectric layer according to the present invention.
Figure 8A:
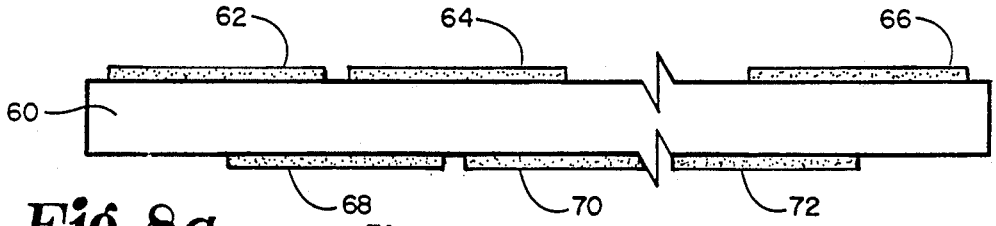
FIG. 8A is a side view of the dielectric layer shown in FIG. 8.
Figure 8B:
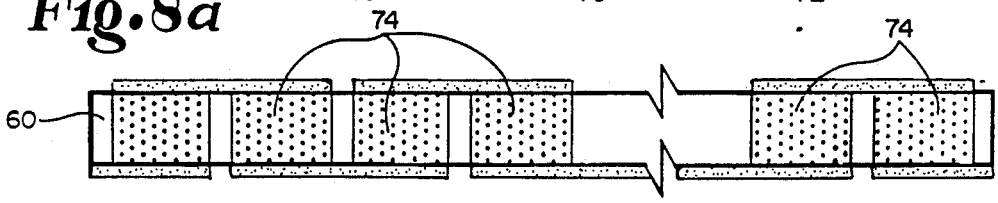
FIG. 8B shows capacitive regions of the dielectric layer shown in FIG. 8A.
Figure 8C:
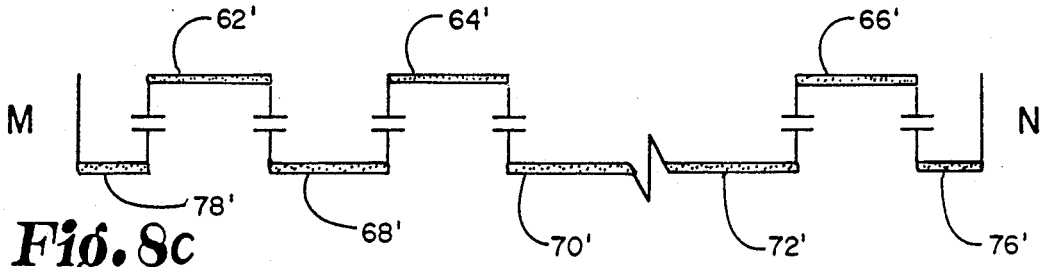
FIG. 8C is a diagram showing an effective circuit representative of the dielectric layer shown in FIG. 8B.

FIGS. 8–8C show one example of an artificial dielectric which can be used to mathematically illustrate the effective increase in the dielectric constant of a normal dielectric structure. FIG. 8 shows a silicon bar 60 having metal patches (such as silver) 62, 64 and 66 painted on its surface. These metal paint patches can be any number of shapes, but in this preferred embodiment they are generally rectangular shapes with a first side of length h and having a width w. The silicon bar has a thickness d, and the lateral spacing between metal patches 62 and 64 has a dimension t. It should be noted that metal patches are uniformly painted along bar 60, but for the sake of clarity, only patches 62, 64 and 66 are illustrated.

FIG. 8A shows that bar 60 also has a second layer of silver paint patches applied on a second side of bar 60. Patches 68, 70 and 72 are offset from patches 62, 64 and 66 by one half the distance h. The effect of the overlap arrangement of the metal patches is that capacitive regions 74 are formed between the overlapping sections of the metallic patches. The capacitive regions in the dielectric structure shown in FIGS. 8 and 8A are shown as cross-hatched areas in FIG. 8B.

FIG. 8C shows the circuit equivalent of the dielectric shown in FIG. 8B. The circuit equivalent includes conductors 62', 64 , 66', 68', 70', 72', 76' and 78'. End plates M and N are also included.

For a one meter spacing between the silver patches, there are approximately $2/(h+t)$ capacitors in series. Each of those capacitors have a capacitance equal to:

$$C = \frac{\epsilon w(h - t)}{2d} \quad \text{Eq. 6}$$

Hence, the capacitance between plates M and N in FIG. 8C is:

$$C_p = \frac{C}{2}; \quad \text{Eq. 7}$$

where the conductive patches are included; and $$C_{np} = \frac{\epsilon wd}{1} \quad \text{Eq. 8}$$

where no conductive patches are included.

The ratio of the dielectric constants with and without the conductive patches can be equated to the ratio of the capacitances with and without the conductive patches. Therefore:

$$\frac{\epsilon_p}{\epsilon_{np}} = \frac{C_p}{C_{np}} = \frac{(h - t)(h + t)}{4d^2} \quad \text{Eq. 9}$$

Since capacitance and conductance are governed by the same equations, the conductivity of the media is multiplied by the same ratio as the capacitance. Also, the complex relative dielectric constant, $\epsilon_r$, is multiplied by the ratio given in equation 10.

In one embodiment tested, h = 4 mm t = 1 mm and d = 0.32 mm. Thus, the ratio of the dielectric constants is:

$$\frac{\epsilon_p}{\epsilon_{np}} = \frac{C_p}{C_{np}} = \frac{(h - t)(h + t)}{4d^2} = 36.6 \quad \text{Eq. 10}$$

For an unpainted silicon strip, $$\frac{\epsilon_{np}}{\epsilon_0} = 13.7 - j1.05$$

was measured at room temperature. For a painted silicon strip, $$\frac{\epsilon_p}{\epsilon_0} = 501 - j39.3$$

was theoretically calculated. Also, $$\frac{\epsilon_p}{\epsilon_0} = 574 - j59.5$$

was measured.

Figure 9:
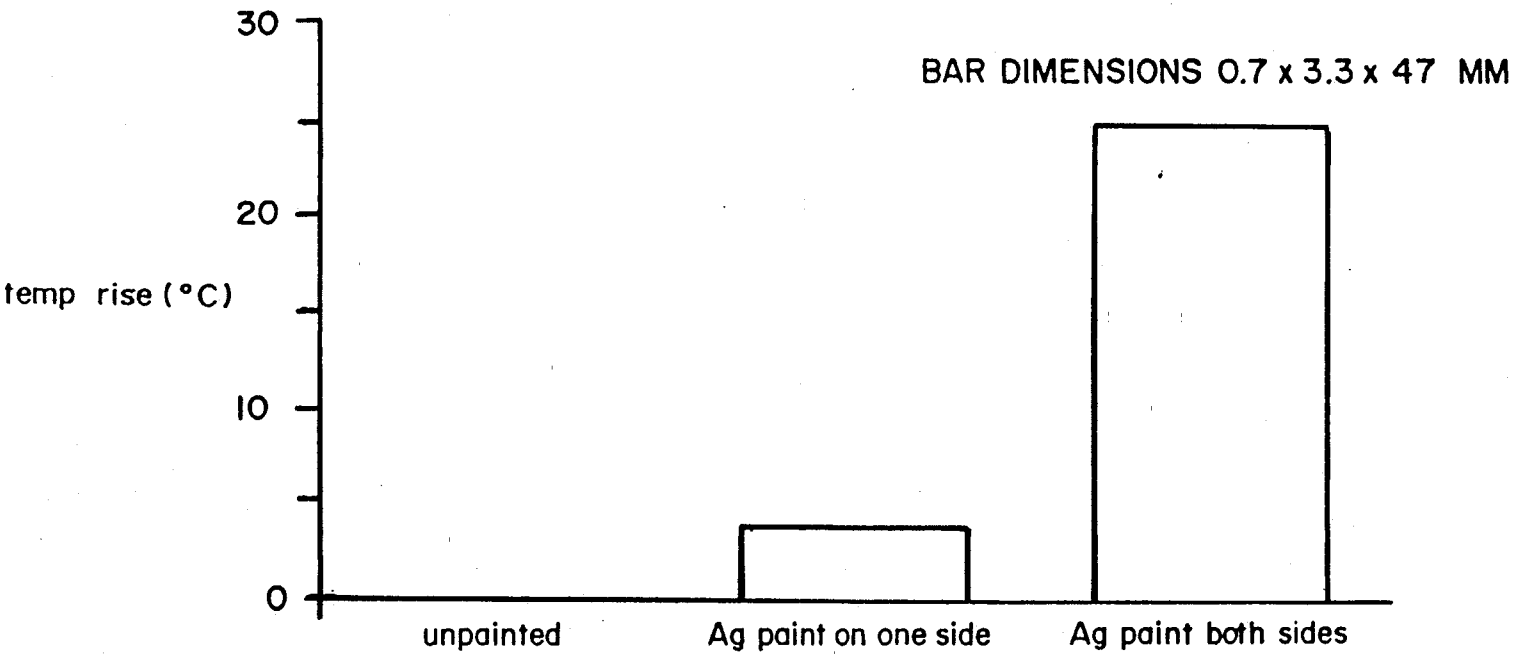
FIG. 9 is a bar graph showing the effect of conductive patches on heating of a silicon bar in a microwave oven.

The significance of this increase in $\epsilon_r''$ is illustrated in FIG. 9 which shows the temperature rise of the silicon bar with staggered plates on two opposite sides, plates on one side only, and with no plates. In each case, the bar was heated in a microwave oven under the same conditions. The bar with plates on both sides experienced a temperature rise six times that of the same bar with patches on only one side. At the same oven power level, the temperature rise of the bar without patches was unobservable.

Thus, it is apparent that loading a dielectric with conductive metal patches increases the dielectric constant $\epsilon_r$ by a factor determined by the size, shape, orientation, and spacing of the metal patches. The effect of dielectric loading on electromagnetic properties of the loaded medium is more fully described in Sergi A. Schelkunoff and Harald T. Friis, *Antennas—Theory and Practice,* (1952) published by Wiley and Sons, Inc., and Robert E. Collin, *Field Theory of Guided Waves,* (1960) published by McGraw Hill Book Co., both of which are incorporated herein by reference.

Figure 10:
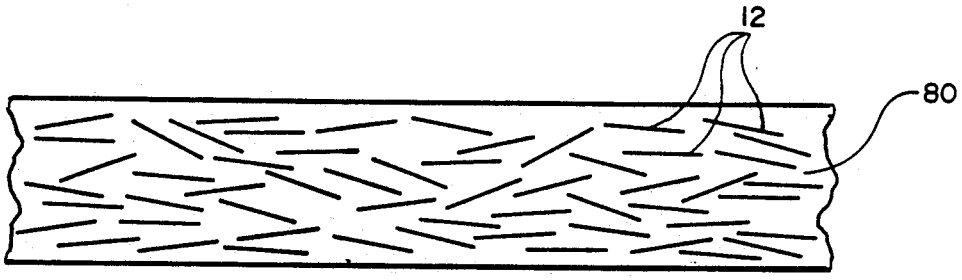
FIG. 10 shows an alternative embodiment of the dielectric layer/of the present invention.

The perfect geometrical arrangement shown in FIGS. 1, 2 and 7–7B may be expensive to build. However, this arrangement may be adequately approximated by semi-randomly loading thin metal plates into dielectric material where the thin metal plates have their broad surfaces nearly parallel to the plane of the dielectric layer, but are otherwise randomly placed in the dielectric material. The essential feature of the dielectric layer 10, shown in FIG. 1, is that there are overlap regions (shown as shaded areas). Each overlap region is a capacitance/conductance cell whose dimensions account for the multiplicative increase in the complex dielectric constant. The s factor can attain values of at least 300 for semi-randomly ordered patches within dielectric material. Such a semi-random ordering is shown in FIG. 10. FIG. 10 includes a polymer material 80, such as paint, semi-randomly loaded with metal patches 12.

Figure 11:
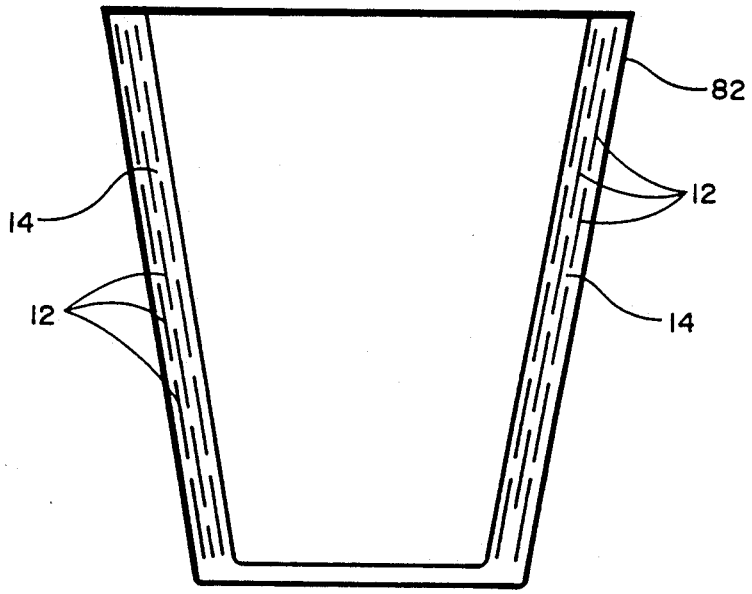
FIG. 11 shows a second implementation of the apparatus of the present invention.

It should also be noted that, while the present invention has been described with reference to generally horizontally planar food products and dielectric layers, such a limitation is not required. FIG. 11 shows a cup 82 (e.g., a coffee mug) with a dielectric layer located within the walls of cup 82. The dielectric layer is located in generally coaxially arranged layers. These layers adjust the standing wave in the microwave oven to improve heating of the contents of the mug.

The effectiveness of this invention was demonstrated by microwave heating Totino's Microwave Pizzas with or without an artificial dielectric structure 10. Two ovens were used in the test: a 450 watt Kenmore and a 750 watt Sanyo (with a power supply modified by Gerling Laboratories of Modesto, Calif.). The pizzas were microwaved at full power until the cheese was completely melted. The artificial dielectric layer was patterned from FIGS. 7, 7A, and 7B. The aluminum foil square patches were 2.0 cm on a side and the spacing between patches was 0.2 cm. The dielectric layers 48, 52, and 56 were made from three pieces of corrugated board, each 0.33 cm thick. The cooking stack was as shown in FIG. 6; when the 1 cm thick artificial dielectric layer 10 was used, the thickness of air layer 28 was 1.8 cm, in the control experiments, which did not use artificial dielectric layer 10, the thickness of air layer 10 was 2.8 cm. After cooking, pizza crust temperature statistics were measured using an Agema Thermovision infrared camera; the average, minimum, and maximum crust temperatures were recorded. The pizzas prepared using the artificial dielectric device 10 were noticeably crisper.

| | Gerling modified Sanyo 750 Watts | Kenmore 450 Watts |
|---|---|---|
| Average Temperature | | |
| no artificial dielectric | 99.7 ± 4.1° C. | 103.1 ± 3.4 C. |
| with artificial dielectric | 111.2 ± 6.2 C. | 110.3 ± 0.6 C. |
| Minimum Temperature | | |
| no artificial dielectric | 62.6 ± 3.0 C. | 66.0 ± 1.8 C. |
| with artificial dielectric | 79.7 ± 6.9 C. | 72.6 ± 0.7 C. |

-continued

| | Gerling modified Sanyo 750 Watts | Kenmore 450 Watts |
|---|---|---|
| Maximum Temperature | | |
| no artificial dielectric | 131.0 ± 7.0 C. | 144.0 ± 2.3 C. |
| with artificial dielectric | 152.7 ± 12.1 C. | 161.7 ± 4.9 C. |

CONCLUSION

The present invention allows a food product in a microwave oven to be positioned for desired cooking performance in a practical manner. A food product can be placed within the microwave oven a desired distance from the oven shelf where that distance is capable of being attained through practical means.

Using an artificial dielectric structure of the present invention, the standing wave pattern in the microwave oven can be adjusted. This adjustment allows the food product to be located relative to the electric field in the oven for desired cooking performance.

In addition, the dielectric structure of the present invention is capable of being implemented within a food product package. Thus, the package itself can be used as a cooking stand in a cooking stack. This allows the cooking stack to be properly positioned with little effort.

Although the present invention has been described with reference to preferred embodiments, workers skilled in the art will recognize that changes may be made in form and detail without departing from the spirit and scope of the invention.

What is claimed is:

1. An apparatus suitable for being placed in a microwave oven to locate a food product at a desired effective cooking height above an oven shelf in the microwave oven, the apparatus comprising:

a food supporting structure having a food contacting surface;

an artificial dielectric structure having a plurality of layers of laterally spaced conductive portions of material generally aligned such that the spaced conductive portions of material in each layer are offset and overlapping relative to the spaced conductive portions of material in adjacent layers to form overlapping regions of conductive material, the overlapping regions being spaced apart, being coupled to the food supporting structure, and having a real part of its complex dielectric value whereby the artificial dielectric structure has a desired electrical thickness so the food product absorbs a desired amount of microwave energy; and spacing means, coupled to the food supporting structure, for spacing the food supporting structure at a desired distance from the oven shelf.

2. The apparatus of claim 1 and further comprising:

a susceptor coupled to the food supporting structure.

3. The apparatus of claim 1 wherein the artificial dielectric structure comprises:

a dielectric material; and wherein the overlapping regions of conductive material are arranged in a plurality of conductive layers coupled to at least a portion of the dielectric material.

4. The apparatus of claim 3 wherein each of the plurality of conductive layers comprises:

a plurality of spaced metal patches aligned in a generally planar arrangement.

5. The apparatus of claim 4 wherein the spaced metal patches are generally square.

6. The apparatus of claim 1 wherein the spacing means comprises:

a food package.

7. The food package of claim 1 wherein the artificial dielectric structure includes a dielectric support media and wherein the overlapping regions of conductive material comprise a plurality of metal flakes loaded into the dielectric support media.

8. An apparatus for adjusting a standing wave pattern of microwaves in a microwave oven wherein the apparatus is used with a support media which is used for supporting a food product in the microwave oven during cooking, the apparatus comprising:

an artificial dielectric layer, coupled to the support media, having a thickness chosen to achieve a desired cooking performance, the artificial dielectric layer including a plurality of layers of laterally spaced conductive portions of material, the plurality of layers being generally located in parallel planes and aligned such that the spaced conductive portions of material in each layer are laterally offset and overlapping relative to the spaced conductive portions of material in adjacent layers to form a plurality of overlapping regions of conductive material.

9. The apparatus of claim 8 wherein the artificial dielectric layer comprises:

a dielectric substance; and wherein the overlapping regions of conductive material are arranged in a plurality of conductive layers having a plurality of conductive patches in each of the conductive layers, coupled to the dielectric substance so the dielectric substance is divided into a plurality of generally parallel layers.

10. The apparatus of claim 9 wherein each of the plurality of conductive layers comprises:

a plurality of spaced metal patches aligned in a generally planar arrangement.

11. A food package for packaging a food product, the food package comprising:

a first side panel;

a second side panel coupled to the first side panel for containment of the food product between the first and the second side panels; and an artificial dielectric structure coupled to at least one of the first and second side panels, the artificial dielectric structure having a real part of its complex dielectric value whereby the artificial dielectric structure has a desired electrical thickness, the artificial dielectric structure including a plurality of layers of laterally spaced portions of conductive material, the plurality of layers being generally located in parallel planes and aligned such that the spaced portions of conductive material in each layer are laterally offset relative to the spaced portions of conductive material in adjacent layers to form overlapping regions of conductive material.

12. The food package of claim 11 wherein the overlapping regions comprise:

a plurality of conductive layers coupled to at least a portion of a dielectric material.

13. The food package of claim 11 wherein each of the plurality of conductive layers comprises:

a plurality of spaced metal patches aligned in a generally planar arrangement.

14. The food package of claim 13 wherein the spaced metal patches are generally square.

15. The food package of claim 11 wherein the artificial dielectric includes a dielectric portion which comprises paint, and wherein the overlapping regions of conductive material comprise a plurality of metal flakes loaded into the paint.

16. The food package of claim 11 and further comprising:

a susceptor coupled to one of the first and second side panels.

17. The food package of claim 16 wherein the artificial dielectric structure is coupled between the susceptor and the first side panel of the food package.

* * * * *